United States Patent [19]

Childs et al.

[11] 4,268,803

[45] May 19, 1981

[54] PERIODIC LID FOR INTEGRATED CIRCUIT

[75] Inventors: William H. Childs, Gaithersburg; Peter A. Carlton, Clarksburg, both of Md.

[73] Assignee: Communications Satellite Corporation, Washington, D.C.

[21] Appl. No.: 42,376

[22] Filed: May 24, 1979

[51] Int. Cl.[3] ..... H01P 1/16; H01P 3/08; H01P 1/162

[52] U.S. Cl. ..... 333/12; 333/202; 333/246; 333/251

[58] Field of Search ..... 333/12, 245–248, 333/210, 212, 228, 238, 251, 202; 361/390, 395, 415, 424

[56] References Cited

U.S. PATENT DOCUMENTS

| | | | |
|---|---|---|---|
| 3,050,606 | 8/1962 | Tibbs | 333/248 X |
| 3,768,048 | 10/1973 | Jones, Jr. et al. | 333/246 X |
| 3,936,778 | 2/1976 | DeRonde | 333/246 |
| 4,048,597 | 9/1977 | Knight et al. | 333/238 X |

*Primary Examiner*—Marvin L. Nussbaum
*Attorney, Agent, or Firm*—Sughrue, Rothwell, Mion, Zinn and Macpeak

[57] ABSTRACT

Periodic fins are provided on the lid of a microwave integrated circuit (MIC) package in order to reactively suppress specified bands of frequency and thereby increase the permissible dimensions of the MIC package.

5 Claims, 6 Drawing Figures

FIG 1
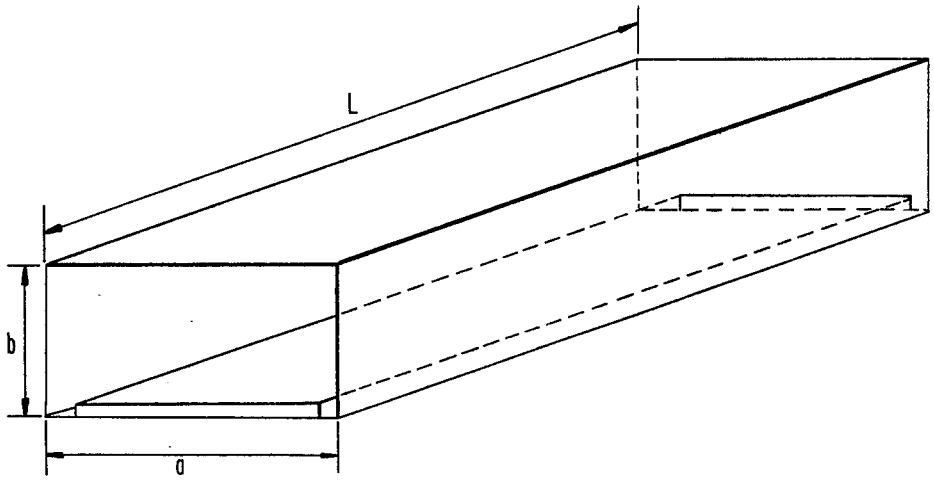
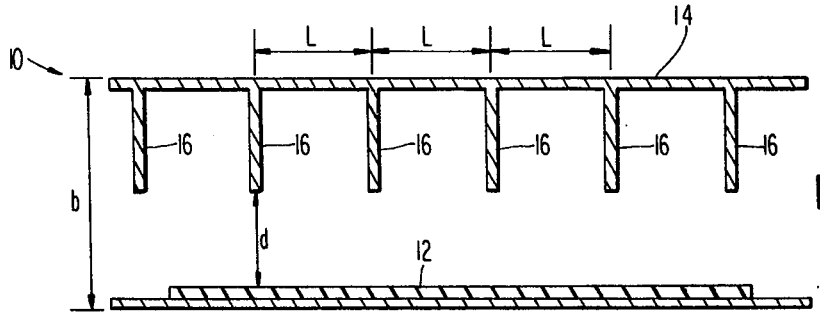
FIG 2
FIG 3
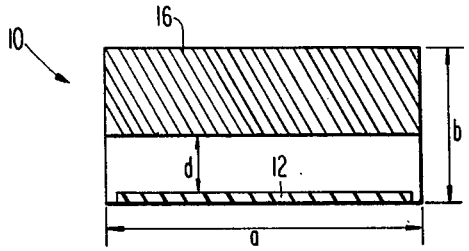

FIG 4a $\beta - \beta_c$ DIAGRAM
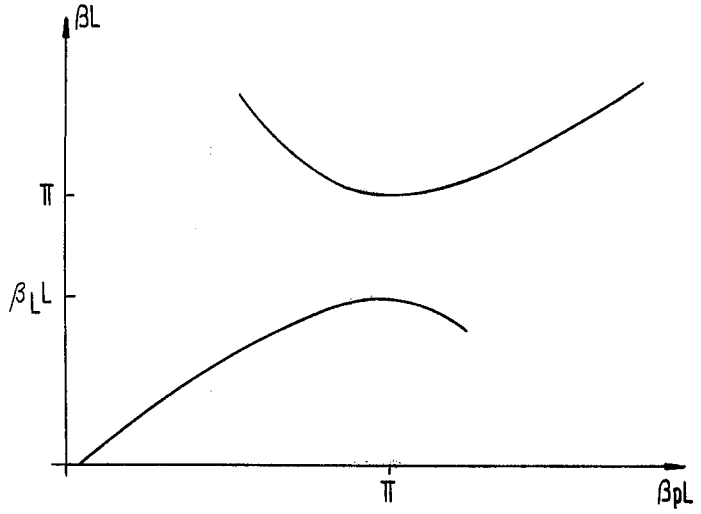
FIG 4b $F - \beta_c$ DIAGRAM
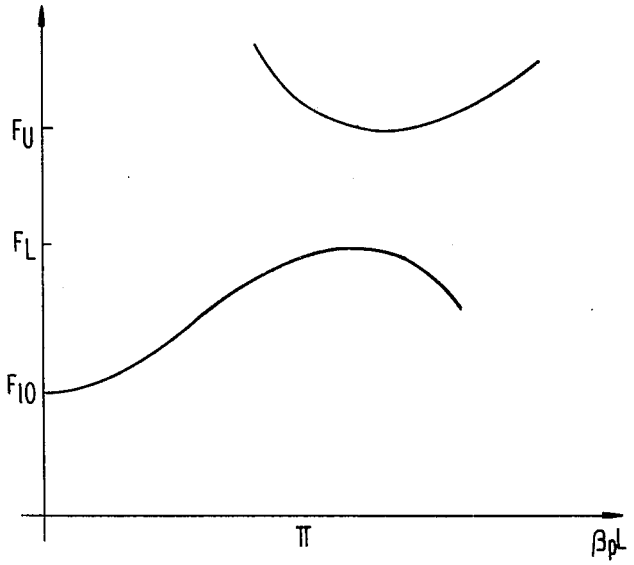

PERIODIC LID FOR INTEGRATED CIRCUIT

BACKGROUND OF THE INVENTION

Microwave integrated circuit (MIC) packages are generally well-known and typically consist of a printed transmission media, e.g., microstrip, on a dielectric substrate within a shielding enclosure. Such devices can be highly useful, but it is obviously necessary that the circuit performance be controlled by the design of the microstrip. However, a problem which is characteristic of MIC packages is that the signals on the microstrip circuitry will radiate to a certain degree within the shielding enclosure. The enclosure will function as a waveguide and undesirable and unpredictable waveguide modes will propagate within the enclosure and interfere with the MIC operation.

The most common method of dealing with this problem is to dimension the cavity such that it functions as a waveguide below cutoff. This can be more clearly understood by referring to FIG. 1 in which an ideal cavity is shown having length L, width a and height b. The cavity 10 contains on its lower surface a dielectric substrate 12. The microstrip circuitry (not shown) will be printed on the surface of the dielectric. It should, of course, be realized that the MIC enclosure will have end surfaces, but these are not shown in FIG. 1. Further, the cavity in FIG. 1 is an ideal cavity, and deviations from the cavity such as reliefs for milling tools will represent minor perturbations.

The problem of undesirable modes resonating within the waveguide enclosure is typically solved by selecting the dimensions of the enclosure such that at least two dimensions are small enough so that the MIC package will operate as a waveguide below cutoff. If only one of the dimensions is below cutoff, it is possible for waveguide modes to propagate within the cavity and interfere with the MIC performance. As shown in FIG. 1, the easiest dimension to minimize is the height b, since the thickness of the MIC board can be extremely small. However, the length L and width a of the package determine the available surface area of the substrate upon which the microstrip circuitry can be formed. In conventional MIC packages the width a is chosen to be below cutoff, but this imposes a substantial restriction on the size of the MIC.

The problem of undesirable modes within the MIC package has been recognized, and several solutions proposed. For example, U.S. Pat. No. 3,863,181 to Glance et al. proposes to provide a groove in the side wall of the enclosure or channel and running around the entire length of the channel. However, such a groove may be difficult to machine. Further, the provision of such a groove would be impractical in existing MIC packages and, therefore, the implementation of the Glance et al. technique would, from a practical viewpoint, necessitate the replacement of all existing MIC packages.

A further solution has been proposed in U.S. Pat. No. 3,936,778 to DeRonde. DeRonde teaches the provision of a conductive member between the substrate and the wall of the enclosure in the vicinity of the launch areas, i.e., in the vicinity of the coax-to-microstrip transitions at either end of the MIC package. However, the theory of operation of the DeRonde improvement is somewhat uncertain. As the length of the cavity increases substantially, it is doubtful that one mode suppressing pin, as shown for example in FIG. 2 of that reference at either end of the enclosure will provide sufficient suppression of the waveguide modes within the cavity.

SUMMARY OF THE INVENTION

It is, therefore, an object of the present invention to provide a MIC package in which an unwanted frequency band of waveguide modes within the cavity are suppressed, thereby permitting substrates of larger area to be used in the MIC.

It is a further object of this invention to provide a means for suppressing unwanted waveguide modes within the MIC cavity which can be easily adapted to existing MIC packages.

Briefly, these and other objects are achieved by providing a plurality of fins on the lid of the MIC package, the fins being spaced at regular intervals to thereby convert the cavity into a periodic structure which will suppress waveguide resonance in certain frequency bands. The suppressed band can be determined by the dimensions and spacing of the periodic fins. Existing MIC packages could be provided with the suppression feature of the present invention by merely machining the lids of these MIC packages so that the fins are formed therein, or by merely replacing the conventional lid of the MIC package with one formed in accordance with the principles of the present invention.

BRIEF DESCRIPTION OF THE DRAWINGS

The invention will be more clearly understood from the following description taken in conjunction with the accompanying drawings in which:

FIG. 1 is a perspective view of an ideal cavity containing a MIC board;

FIG. 2 is a side sectional view of the structure of FIG. 1 when provided with the periodic mode suppression fins according to the present invention;

FIG. 3 is an end view of the structure of FIG. 1 when provided with the periodic mode suppression fins according to the present invention;

FIGS. 4*a* and 4*b* are plots of $\beta$ versus $\beta_p$ and F versus $\beta_p$, respectively, for periodic waveguides.

DETAILED DESCRIPTION OF THE INVENTION

Figure 5:
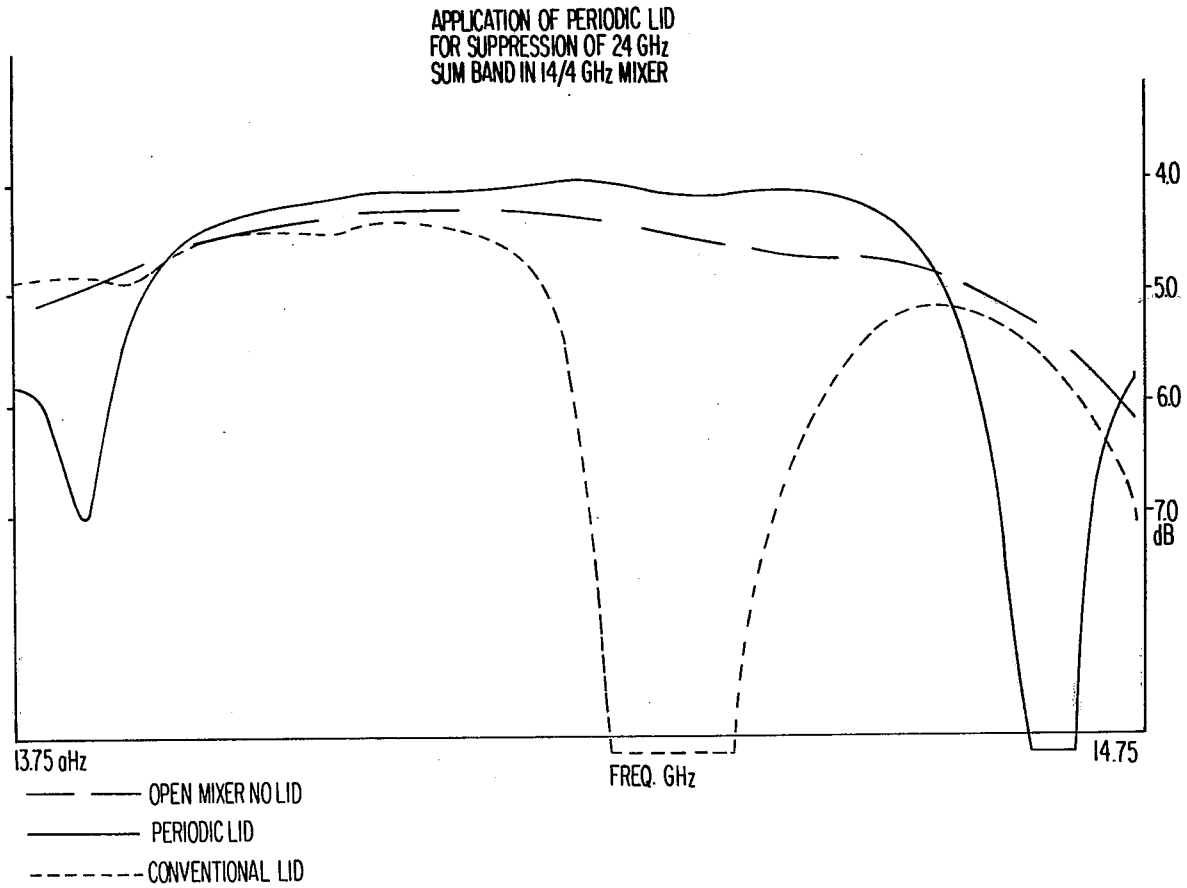
FIG. 5 is a plot of the conversion loss of a 14/4 GHz mixer with a conventional lid and a periodic lid according to the present invention.

The present invention will now be described with reference to FIGS. 2 and 3. FIG. 2 is a side sectional view of the MIC package shown in FIG. 1 with the addition of the periodic suppression fins. The lid 14 of the package is provided with conductive fins 16 which convert the cavity into a periodic structure. The distance between the lower edge of each fin and the surface of the substrate 12 is represented by d. The ratio d/b as well as the fin spacing L are selected to provide stop bands for unwanted frequencies. As long as the higher order mode frequencies at which the troublesome waveguide resonance occurs lie within these frequency stop bands, the width of the substrate can be substantially doubled.

The selection of the ratio d/b and fin spacing L can be accomplished according to known principles of analysis of periodic structures, e.g., R. E. Collin, *Field Theory of Guided Waves,* McGraw-Hill Book Company, N.I.C. 1960. The implementation of the periodic lid according to the present invention can be easily understood from the following analysis.

First, it is known that the following relationships are true for an unperturbed waveguide:

$$F_{10} = V_l/2a \tag{1}$$

$$\beta = \frac{\pi}{a}\sqrt{\left(\frac{F}{F_{10}}\right)^2 - 1}$$

which can be rearranged to $$\frac{F}{F_{10}} = \sqrt{\left(\frac{a\beta}{\pi}\right)^2 + 1} \tag{2}$$

where $F_{10}$ is the frequency of the $TE_{10}$ resonant mode within the waveguide, $v_l$ is the propagation velocity within the waveguide and $\beta$ is the wave number of the unperturbed waveguide. $\beta$ is typically defined as ($\omega$/propagation velocity) where the propagation velocity is approximately equal to the speed of light.

It is further known, for example from equation 49(b) in the above-referenced publication by R. E. Collin, that the following relationship holds true for a periodic waveguide:

$$\cos \beta_p L = \cos \beta L - \frac{B}{2} \sin \beta L \tag{3}$$

where L is the periodicity of the fins or spacing between the fins and $\beta_p$ is the wave number of the periodic waveguide.

In designing a MIC package having an increased substrate area, it is possible to provide a cavity having a width which is larger than the required cutoff dimension, however, the height b should still be less than the cutoff dimension. A suitable value for the height b would be ten times the substrate height, the substrate height, or thickness, being chosen in accordance with well known principles depending on the operating frequencies of the microstrip. Since the height will still be below the cutoff dimension the onset of waveguide propagation in the cavity will be determined by the width a. The resonant frequencies of various resonant modes within a cavity can be determined by:

$$\frac{F_{mn}}{F_{10}} = \sqrt{m^2 + n^2\left(\frac{a}{b}\right)^2} \tag{4}$$

where $F_{mn}$ is the frequency of the $TE_{mn}$ mode within the cavity. According to the equation (4) the frequency $F_{20}$ is equal to $2F_{10}$ regardless of the cavity dimensions and the frequency $F_{01}$ is equal to $(a/b)F_{10}$. These frequencies $F_{20}$ and $F_{01}$ are the frequencies at which the cavity will be capable of supporting the $TE_{20}$ and $TE_{01}$ resonant modes respectively. These are the next highest modes of resonance above the desired resonant frequency $F_{10}$. These resonant modes will be extremely difficult to suppress, and it is therefore desirable to locate them as far as possible from $F_{10}$. Accordingly (a/b) should be selected so that $F_{01}$ is no closer than $F_{20}$ or, in other words, b should be less than or equal to 0.5a.

For the sake of the following discussion, it is assumed that b is less than or equal to (a/2) so that the next highest mode of interest is $2F_{10}$. It would be quite advantageous to suppress interfering resonance between $F_{10}$ and $2F_{10}$.

FIGS. 4a and 4b are plots of $\beta$ versus $\beta_p$ and F versus $\beta_p$, respectively, for periodic waveguides. As shown in FIG. 4b, the periodic waveguide will be incapable of supporting resonance between an upper stop band frequency $F_U$ and a lower stop band frequency $F_L$. It is necessary, then, to select the dimensions of the periodic structure such that the frequencies to be suppressed lie within the range of $F_L$-$F_U$.

The upper and lower stop band frequencies can be expressed by the following equations, (5) and (6), respectively:

$$\frac{F_u}{F_{10}} = \sqrt{\left(\frac{a}{L}\right)^2 + 1} \tag{5}$$

$$\frac{F_L}{F_{10}} = \sqrt{\left(\frac{a\beta_L L}{L\pi}\right)^2 + 1} \tag{6}$$

where $\beta_L$ is the wave number at the lower edge of the stop band. $\beta_L$ is arrived at by first determining $\beta_p L$ from the plot of FIG. 4b and then determining $\beta_L$ from the plot of FIG. 4a.

The periodicity, or fin spacing L, can be determined from equation (5) for $F_U \leqq 2F_{10}$. The spacing L must then be less than $(a/\sqrt{3})$.

Further, for a lower stop band frequency $F_L$, the wave number $\beta_L$ can be determined by the equation:

$$\beta_L L = \frac{\pi L}{a}\sqrt{\left(\frac{F_L}{F_{10}}\right)^2 - 1} \tag{7}$$

which is derived from equation (6) given above.

At the lower stop band edge, $F_L$, FIG. 4b indicates that $\beta_p L$ will be equal to $\pi$. Thus, at the lower band edge from equation (3), we have $$\cos \beta_p L = -1 = \cos \beta_L L - \frac{B(F_L)}{2} \sin \beta L \tag{8}$$

where $B(F_L)$ is the required susceptance at the lower band edge.

Turning again to the above-referenced publication by R. E. Collin, equation 5.26 therein gives the susceptance of a periodic waveguide as $$B = \frac{4\beta b}{\pi}\left[\ln \csc\left(\frac{\pi}{2}\ \frac{d}{b}\right) + \left(\frac{\pi}{b\gamma_1} - 1\right)\cos^4\left(\frac{\pi}{2}\ \frac{d}{b}\right)\right] \tag{9}$$

combining this with equations (1) and (2) will result in $$B = C_1 \ln \csc x + C_2 \cos^4 x \tag{10}$$

where $$C_1 = 4\beta b,/\pi, \tag{10a}$$

$$C_2 = C_1\left(\frac{1}{\sqrt{1-(C_1)^2}} - 1\right), \text{ and} \quad (10b)$$

$$x = \pi/2 \cdot d/b \quad (10c)$$

Since the susceptance B has already been determined by equation (8), solving the equation (10) for x will result in the determination of the ratio (d/b) from equation (10c). Solving equation (10) for x can be done iteratively in a well known manner. For example, by defining a function F by $$F = C_1 \ln \csc x + C_2 \cos^4 x - B \quad (11)$$

F′ is then given by $$\frac{dF}{dx} = -C_1 \cot x - 4\, C_2 \cos^3 \times \sin x \quad (12)$$

Using these values in the expression $$X_{new} = X_{old} - \frac{F(X_{old})}{F'(X_{old})} \quad (13)$$

will result in a converging value of x. When the value has converged, the relationship (d/b) can be determined from equation (10c).

The above analysis is based on known principles of periodic waveguide structures and would be a relatively simple matter for one of ordinary skill in the art, particularly with the help of a suitable calculator or computer program.

A number of design examples will now be described. In each of the examples, the width a and height b were selected as 0.4 inches and 0.2 inches, respectively, giving a frequency $F_{10}$ of 14.75 GHz. In such a cavity, it has been determined that resonant energy at about 24 GHz will cause an undesirable interference with the MIC performance. Thus, it would be desirable to design the MIC package so that the cavity would suppress a range of frequencies which included 24 GHz.

EXAMPLE 1

In the first example, it is desirable to suppress a band of frequencies from $F_L$=20 GHz to $F_U$=26 GHz. Plugging these values of a, $F_U$ and $F_{10}$ into equation (5) yields a periodicity L of 0.276 inches. Using this known value of L together with the given values of $F_L$, $F_{10}$ and a in equation (7) yields a wave number at the lower edge of the stop band of $0.63\pi$. Using the now known values of L, $\beta_L$ and $F_L$ in equation (8) yields a $B(F_L)$ of 1.310. Using these values to iteratively solve equations (9)–(13) will yield, from equation (10c), a ratio d/b of 0.35.

EXAMPLE 2

In Example 2, the desired stop band is between 23.0 GHz and 26.0 GHz. Following the same procedure as in Example 1, the calculated ratio d/b is 0.605.

EXAMPLE 3

In Example 3, the desired stop band is between 20 GHz and 25 GHz. Following the same procedure as in Example 1, the calculated ratio d/b is 0.384.

EXAMPLE 4

In Example 4, the desired stop band is between 24 GHz and 25 GHz. Following the same procedure as in Example 1, the calculated ratio d/b is 0.763.

In each of the examples, the periodic lid was intended for use in a 14/4 mixer. In such a mixer, the input frequency band was 13.75 to 14.75 GHz with a local oscillator frequency of 10.3 GHz, thus resulting in conversion to an IF frequency band of about 3.45 to 4.45 GHz. The sum sideband, however, will exist at 24.05 to 25.05 GHz. This may cause a length resonance in the 24–25 GHz range which could result in the subtraction of energy from the 14/4 frequency conversion. In each of the examples, the cavity width was approximately 0.4 inches, a width which would normally result in the onset of waveguide modes at approximately 15 GHz. Since the energy in the 15–20 GHz band would be negligible, the periodic lid was designed to suppress only frequencies above 20 GHz, and all examples suppress the troublesome sum intermodulation product at 24–25 GHz.

Shown in FIG. 5 is the conversion loss of a mixer provided with a periodic lid according to the present invention. FIG. 5 shows that a mixer provided with a conventional lid will exhibit a large loss at about 14.0 GHz. This is attributed to the sum energy at 24 GHz resonating in the long dimension and subtracting from the desired 14/4 frequency conversion. Further, the conversion loss of the device when provided with a conventional lid is not significantly improved over the case in which no lid at all is employed. Providing the mixer with a periodic lid according to the present invention results in a smooth and near optimum response over the 14.0–14.5 GHz band. This is evidence of the reactive suppression of the sum sideband by the periodic lid structure. Also, the conversion loss of the MIC mixer is improved by as much as 0.5 db or more at some frequencies within the operating band. Thus, substrate widths which would ordinarily be unacceptable due to waveguide modes resonating in the cavity can now be used due to the reactive suppression of the periodic lid structure.

What is claimed is:

1. In a microwave integrated circuit (MIC) package of the type having a substrate, a conductive pattern on the upper surface of said substrate and a conductive enclosure containing said substrate, the interior of said conductive enclosure having a width a and a height b the improvement comprising a plurality of regularly spaced conductive members extending from the upper surface of said enclosure toward the substrate for converting said enclosure into a periodic structure and thereby suppressing a band of resonant frequencies within said enclosure.

2. A MIC package as defined in claim 1, wherein said conductive members are fins disposed transversely in said enclosure.

3. A MIC package as defined claims 1 or 2, wherein the distance between said conductive members is L and the distance between the lower end of each conductive member and the substrate is d and L, and the ratio (d/b) are chosen to suppress a desired frequency band.

4. A MIC package as defined in claim 3, wherein the distance L is given by $$\frac{F_U}{F_{10}} = \sqrt{\left(\frac{a}{L}\right)^2 + 1}$$

where $F_U$ is the upper edge of said suppressed frequency band and $F_{10}$ is the frequency at which the $TE_{10}$ mode will resonate within said enclosure.

5. A MIC package according to claim 3 wherein the ratio (d/b) is given by:

$$d/b = 2x/\pi$$

where x is determined by iteratively solving the equation $$X_{new} = X_{old} - \frac{F(X_{old})}{F'(X_{old})}$$

in which $$F = C_1 \ln \csc x + C_2 \cos^4 x - B$$

$$\frac{dF}{dX} = C_1 \cot x - 4\, C_2 \cos^3 \times \sin x$$

$$C_1 = 4\beta b/\pi$$

$$C_2 = C_1\left(\frac{1}{\sqrt{1-(C_1)^2}} - 1\right)$$

B = the required susceptance at lower edge of the suppressed frequency band $\beta$ = the wavenumber of the periodic structure.

* * * * *